US010783756B2

(12) United States Patent
Cho et al.

(10) Patent No.: US 10,783,756 B2
(45) Date of Patent: Sep. 22, 2020

(54) MEDIUM STORAGE APPARATUS FOR AUTOMATED TELLER MACHINE

(71) Applicant: HYOSUNG TNS INC., Seoul (KR)

(72) Inventors: Ji Youn Cho, Seoul (KR); Dong Won Min, Gyeonggi-do (KR); Sung Ho Park, Seoul (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 16/423,308

(22) Filed: May 28, 2019

(65) Prior Publication Data

US 2020/0211334 A1 Jul. 2, 2020

(30) Foreign Application Priority Data

Dec. 28, 2018 (KR) ..... 10-2018-0172250

(51) Int. Cl.
*G07G 1/00* (2006.01)
*G07F 19/00* (2006.01)

(52) U.S. Cl.
CPC ..... *G07G 1/0027* (2013.01); *G07F 19/202* (2013.01); *G07F 19/203* (2013.01)

(58) Field of Classification Search
CPC ..... G07G 1/0027
USPC ..... 235/22, 379
See application file for complete search history.

(56) References Cited

U.S. PATENT DOCUMENTS 6,145,737 A * 11/2000 Imai ..... G07D 11/0096 232/1 D
2005/0010525 A1* 1/2005 Ross ..... G06K 7/0008 705/43
2010/0247000 A1* 9/2010 Goodwin ..... B65D 33/34 383/43
2015/0170450 A1 6/2015 Kimoto et al.
2017/0309133 A1* 10/2017 Okamoto ..... G07D 9/00
2018/0374317 A1 12/2018 Okamoto et al.

FOREIGN PATENT DOCUMENTS

DE 697 04 883 T2 9/2001
KR 10-2014-0052583 5/2014
KR 10-1665609 B1 10/2016

OTHER PUBLICATIONS

Extended European Search Report dated May 14, 2020 issued in corresponding European Patent Application No. 19209692.3.
Korean Office Action dated Jul. 7, 2020 issued in corresponding Korean Patent Application No. 10-2018-0172250.

* cited by examiner

*Primary Examiner* — Allyson N Trail
(74) *Attorney, Agent, or Firm* — Bacon & Thomas, PLLC

(57) ABSTRACT

A medium storage apparatus for an automated teller machine includes a main body, a body cover installed at the main body, and a medium storage box attached to or detached from one side of the body cover while sliding into and out of the body cover and configured to stores a medium. The medium storage apparatus further includes a side door provided on at least one of both side surfaces of the medium storage body and configured to open and close an inner space of the medium storage box. An opening is formed on at least one side surface of the body cover, and the side door is disposed to face the opening.

4 Claims, 4 Drawing Sheets

MEDIUM STORAGE APPARATUS FOR AUTOMATED TELLER MACHINE

CROSS-REFERENCE TO RELATED APPLICATIONS

This application claims priority to Korean Patent Application No. 10-2018-0172250, filed on Dec. 28, 2018, the entire contents of which are incorporated herein by reference.

FIELD OF THE INVENTION

The present disclosure relates to a medium storage apparatus for an automated teller machine.

BACKGROUND OF THE INVENTION

Generally, an automated teller machine (ATM) provides financial services such as deposit and withdrawal of cash and checks using a card or a passbook without the intervention of a bank teller regardless of time and location.

Recently, ATMs are widely used not only in financial institutions such as banks but also in convenience stores, department stores, and public places. An ATM may be classified into a withdrawal machine, a deposit machine, and a deposit and withdrawal machine depending on whether a transaction is a deposit or a withdrawal. Recently, ATMs are variously used for cash deposit/withdrawal, check deposit/withdrawal, passbook update, electronic bill payment, ticket sales, and the like.

Hereinafter, the configuration of an ATM will be briefly described. An ATM includes a medium storage unit for storing a paper medium such as cash, a medium transport unit for transporting the paper medium supplied from the medium storage unit, a medium delivery unit for delivering the paper medium from the medium transport unit to a withdrawal unit, and a collected medium storage unit for storing a paper medium rejected due to abnormality during the transport process in the medium transport unit, or a paper medium that has been supplied to the withdrawal unit but retracted without being received.

In a conventional ATM (see, e.g., Korean Patent No. 10-1665609 registered on Oct. 6, 2016), a medium storage box, provided at the medium storage unit or the collected medium storage unit to store the paper medium, can be attached to or detached from one side of a cover body installed at a main body of the ATM by sliding on the cover body.

The above conventional medium storage box is attached or detached while being coupled to the body cover by a sliding device and slid in a horizontal direction. Therefore, it is required to secure enough space for the medium storage box to move toward or from one side of the body cover during the attachment/detachment of the medium storage box. However, in many cases, even though it is necessary to remove only the medium stored in the medium storage box, the entire medium storage box needs to be pulled out to take out the medium, which is inconvenient. In addition, the body cover needs to be pulled out from the main body or pivoted to secure space for allowing access to the medium storage box, which is also inconvenient.

SUMMARY OF THE INVENTION

In view of the above, the present disclosure provides a medium storage apparatus of an automated teller machine capable of easily extracting a medium when necessary while maintaining a conventional structure in which the medium is deposited and withdrawn as a medium storage box is slid into and out of a body cover.

In accordance with an aspect of the present disclosure, there is provided a medium storage apparatus for an automated teller machine, including: a main body; a body cover installed at the main body; a medium storage box attached to or detached from one side of the body cover while sliding into and out of the body cover and configured to store a medium; and a side door provided on at least one of both side surfaces of the medium storage body and configured to open and close an inner space of the medium storage box, wherein an opening is formed on at least one side surface of the body cover, and the side door is disposed to face the opening.

The medium storage apparatus may further include a hinge portion configured to pivotably connect the side door to the medium storage box.

The side door may be pivoted to project to an outside of the body cover through the opening when the medium storage box is opened.

The medium storage apparatus may further include a handle provided on an outer surface of the side door.

The medium storage box may be a retract box configured to store an unreceived medium.

In accordance with the embodiment of the present disclosure, it is possible to easily and simply extract a medium when necessary without an operation of sliding the medium storage box in a state where the medium storage box is attached to the body cover.

BRIEF DESCRIPTION OF THE DRAWINGS

The objects and features of the present disclosure will become apparent from the following description of embodiments, given in conjunction with the accompanying drawings, in which.

DETAILED DESCRIPTION OF THE EMBODIMENTS

Figure 1:
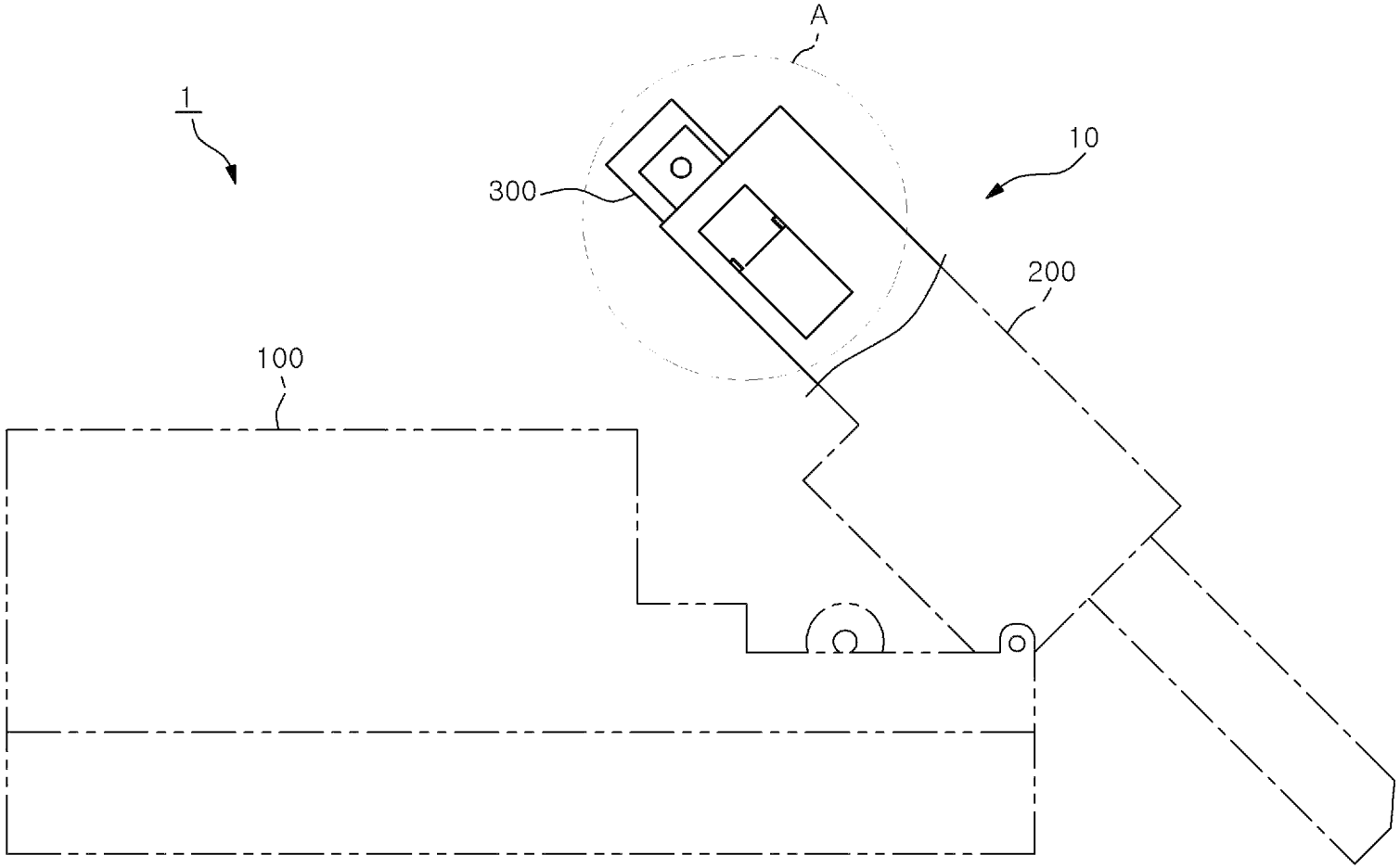
FIG. 1 is a side view schematically showing an ATM provided with a medium storage apparatus according to an embodiment of the present disclosure.

Hereinafter, configurations and operations of embodiments will be described in detail with reference to the accompanying drawings. The following description is one of various patentable aspects of the disclosure and may form a part of the detailed description of the disclosure.

In describing the embodiments of the present disclosure, the detailed descriptions of well-known functions or configurations will be omitted if it is determined that the detailed descriptions of well-known functions or configurations may unnecessarily make obscure the spirit of the present disclosure.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another.

When it is said that a component is "coupled" or "linked" to another component, it should be understood that the former component may be directly connected or linked to the latter component or a third component may be interposed between the two components.

Specific terms used in the present application are used simply to describe specific embodiments without limiting the disclosure. An expression used in the singular encompasses the expression of the plural, unless it has a clearly different meaning in the context.

Hereinafter, an embodiment of the present disclosure will be described in detail with reference to the accompanying drawings.

Referring to FIGS. 1 to 4, a medium storage apparatus 10 of an automated teller machine (ATM) 1 according to an embodiment of the present disclosure may include a main body 100, a body cover 200, and a medium storage box 300.

The embodiment of the present disclosure does not necessarily include only the above-described components. The embodiment of the present disclosure basically includes the above-described components and may further include other configurations (e.g., widely known technologies in the ATM). However, detailed descriptions of known configurations or functions that make the disclosure obscure may be omitted.

The main body 100 forms an overall external appearance of the ATM 1 and serves as a base for installing or embedding other components of the ATM 1. Various electrical and mechanical elements required for the operation of the ATM 1 can be installed at the main body 100.

The body cover 200 is configured to accommodate the medium storage box 300 and may be installed at the main body 100. The body cover 200 is movable from the main body 100 when necessary. In other words, the body cover 200 can be moved from the main body 100 to a predetermined position in order to secure enough space for allowing access to the medium storage box 300 at the time of attaching or detaching the medium storage box 300 to or from the body cover 200.

Therefore, the body cover 200 can secure access space of the medium storage box 300 while being hinge-pivoted from the main body 100 as shown in FIG. 1, or can secure the access space to the medium storage box 300 while being moved vertically, unlike the case shown in FIG. 1.

The medium storage box 300 is configured to store a medium such as a banknote, a check, a gift certificate, a ticket, or the like, and can be slidably attached to or detached from one side of the body cover 200. The medium storage box 300 has therein a storage space for storing the medium, and can slide while being inserted into the body cover 200.

The medium storage box 300 can collect and store a medium that has been withdrawn from a withdrawal unit but retracted without being received, or a medium that has been transported by a medium transport unit but rejected and transported by a rejected medium transport unit. Therefore, the medium storage box 300 may be, e.g., a retract box for storing an unreceived medium.

The medium storage apparatus 10 according to an embodiment of the present disclosure can provide another configuration capable of easily and simply depositing/withdrawing a medium stored in the medium storage box 300 without sliding of the medium storage box 300 at the body cover 200 when necessary, while maintaining the above-described configuration and structure in which the medium storage box 300 slides to store or receive a medium.

Figure 2:
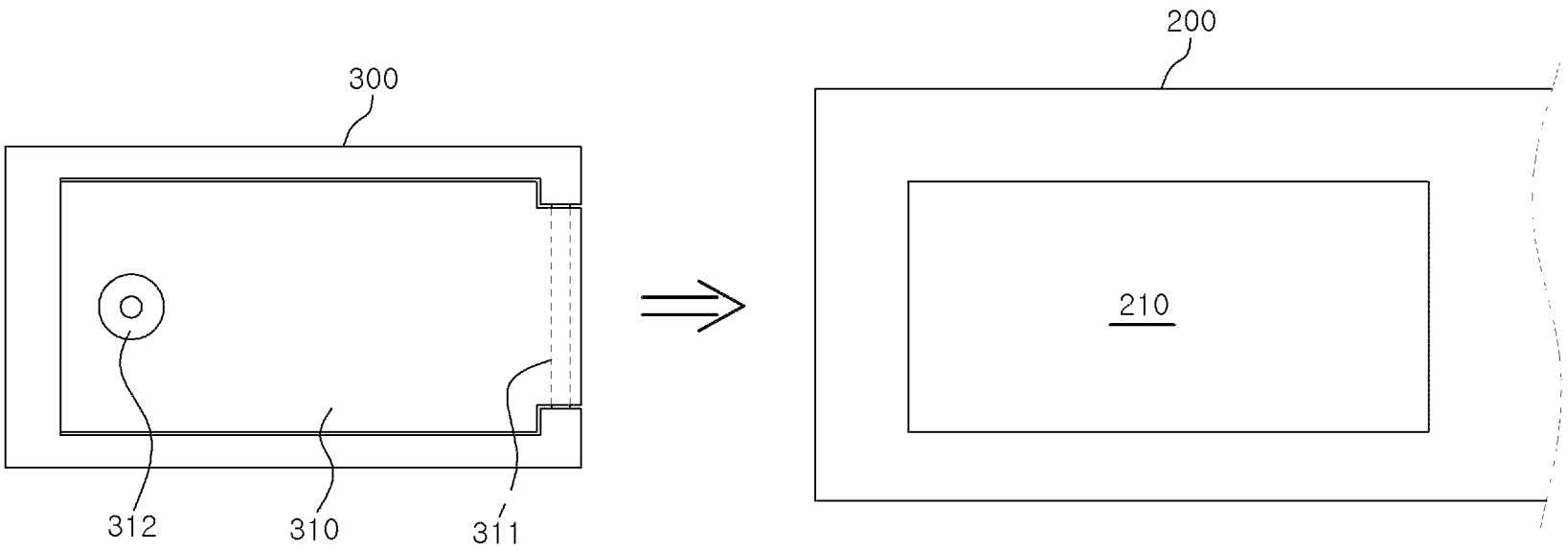
FIG. 2 is a side view schematically showing the medium storage apparatus corresponding to a portion "A" in FIG. 1, and also shows a state in which the medium storage box is pulled out from a body cover.
Figure 3:
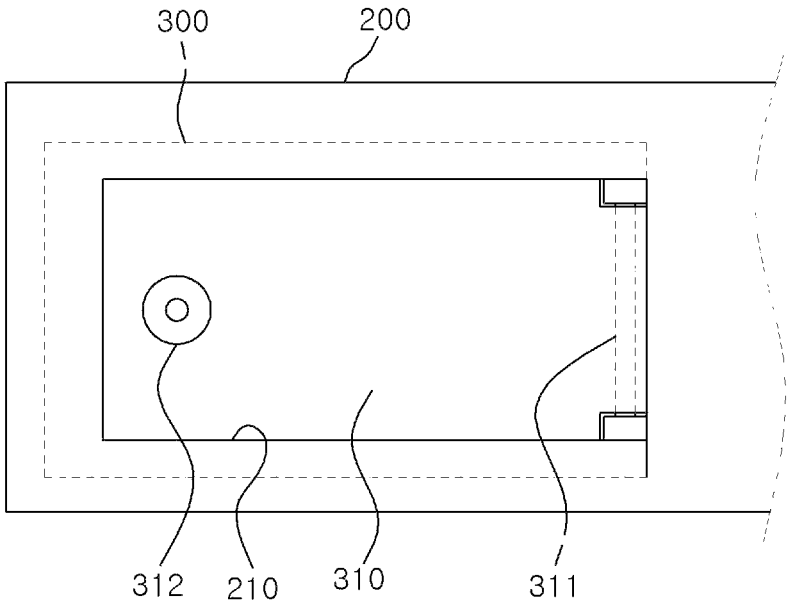
FIG. 3 is a side view showing a state in which the medium storage box is inserted into and attached to the body cover.

Therefore, as shown in FIG. 2, an opening 210 having a predetermined size may be formed on at least one side surface of the body cover 200 where the medium storage box 300 is accommodated. The opening 210 may be formed on one side surface or both side surfaces of the body cover 200. The opening 210 allows access to the medium storage box 300 from the outside of the body cover 200 in a state where the medium storage box 300 is attached to the body cover 200.

A side door 310 may be openably and closably provided at the medium storage box 300. The side door 310 can be installed on at least one of the side surfaces of the medium storage box 300 that faces the opening 210.

Therefore, when the side door 310 is opened in a state where the medium storage box 300 is attached to the body cover 200, the medium stored in the medium storage box 300 can be taken out to the outside of the body cover 200 through the opening 210.

Figure 4:
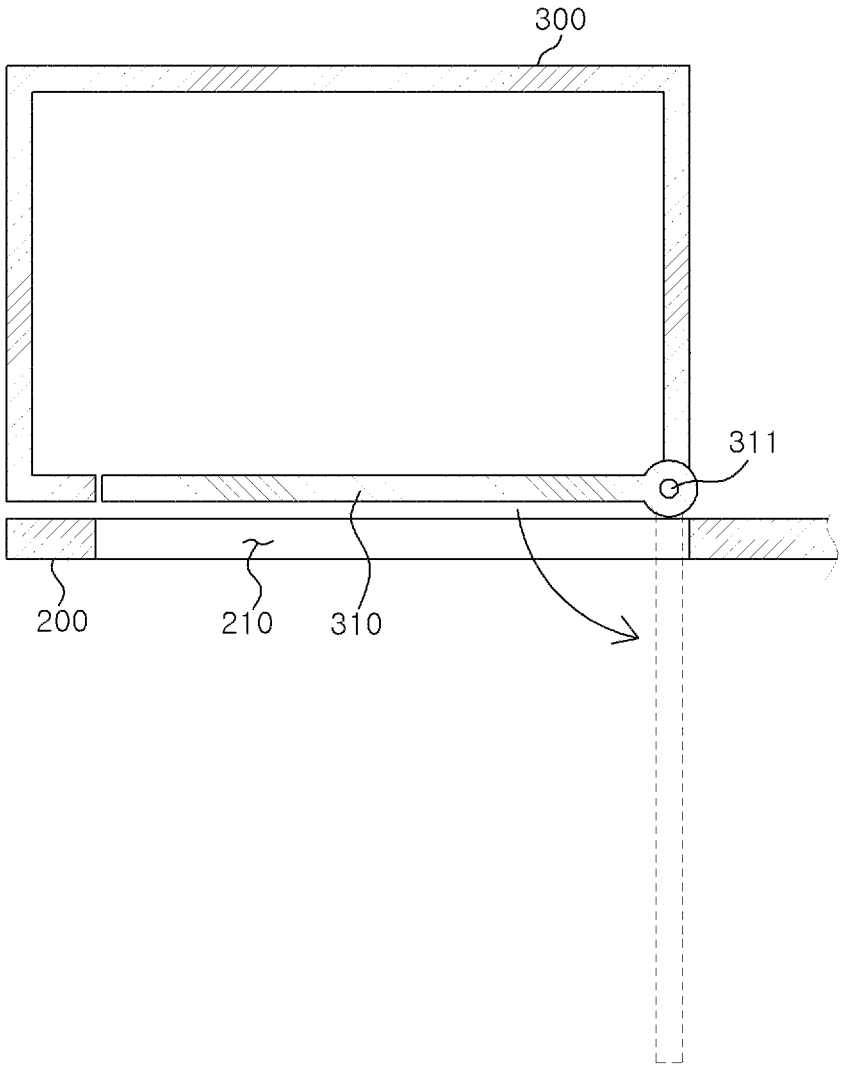
FIG. 4 is a cross sectional plan view schematically showing a process of opening and closing a side door of the medium storage box in the state shown in FIG. 3.

At this time, the side door 310 can be installed at the medium storage box 300 to be pivotable by a hinge portion 311 as shown in FIG. 4, and thus can be opened and closed on the medium storage box 300. When the side door 310 is opened, the side door 310 is pivoted to project to the outside of the body cover 200 through the opening 210.

The side door 310 may have a shutter structure that is opened and closed while sliding vertically or horizontally, instead of a pivot structure that is opened and closed by the hinge portion 311.

In addition, a handle 312 may be provided on an outer surface of the side door 310 to allow a user to hold and easily open/close the side door 310.

While the present disclosure has been shown and described with respect to the embodiments, it will be understood by those skilled in the art that various changes and modifications may be made without departing from the scope of the present disclosure as defined in the following claims.

What is claimed is:

1. A medium storage apparatus for an automated teller machine, comprising:

a main body;

a body cover installed at the main body;

a medium storage box attached to or detached from one side of the body cover while sliding into and out of the body cover and configured to store a medium; and a side door provided on at least one of both side surfaces of the medium storage box and configured to open and close an inner space of the medium storage box, wherein an opening is formed on at least one side surface of the body cover, and the side door is disposed to face the opening, wherein when the medium storage box slides into the body cover, the whole of the medium storage box is accommodated in the body cover, and wherein, when the side door is pivoted to project to an outside of the body cover through the opening, the inner space communicates with the outside of the body cover through the opening.

2. The medium storage apparatus for an automated teller machine of claim 1, further comprising:

a hinge portion configured to pivotably connect the side door to the medium storage box.

3. The medium storage apparatus for an automated teller machine of claim 2, further comprising:

a handle provided on an outer surface of the side door.

4. The medium storage apparatus for an automated teller machine of claim 1, wherein the medium storage box is a retract box configured to store an unreceived medium.

* * * * *